US009024758B2

(12) United States Patent
Bushee

(10) Patent No.: US 9,024,758 B2
(45) Date of Patent: May 5, 2015

(54) COMPACT MULTIFUNCTION PERIMETER AND PERSONAL SECURITY ALARM SYSTEM

(71) Applicant: Glenn Bushee, Duxbury, MA (US)

(72) Inventor: Glenn Bushee, Duxbury, MA (US)

( * ) Notice: Subject to any disclaimer, the term of this patent is extended or adjusted under 35 U.S.C. 154(b) by 167 days.

(21) Appl. No.: 13/943,210

(22) Filed: Jul. 16, 2013

(65) Prior Publication Data

US 2014/0022076 A1 Jan. 23, 2014

Related U.S. Application Data

(60) Provisional application No. 61/672,676, filed on Jul. 17, 2012.

(51) Int. Cl.
*G08B 13/00* (2006.01)
*G08B 13/12* (2006.01)

(52) U.S. Cl.
CPC ..... *G08B 13/12* (2013.01); *G08B 13/122* (2013.01)

(58) Field of Classification Search
CPC ..... G08B 13/12; G08B 13/122; G08B 13/00; G08B 13/02
USPC ..... 340/541
See application file for complete search history.

(56) References Cited

U.S. PATENT DOCUMENTS

| | | | | |
|---|---|---|---|---|
| 4,716,402 | A * | 12/1987 | Francis | 340/546 |
| 5,617,075 | A * | 4/1997 | Worth et al. | 340/574 |
| 6,130,616 | A * | 10/2000 | Sizemore | 340/574 |
| 6,394,116 | B1 * | 5/2002 | Winn et al. | 135/65 |
| 7,557,720 | B2 * | 7/2009 | Rubin et al. | 340/574 |
| 2009/0207595 | A1 * | 8/2009 | Sharrah et al. | 362/158 |
| 2010/0188227 | A1 * | 7/2010 | Yang | 340/572.1 |

* cited by examiner

*Primary Examiner* — Kerri McNally
(74) *Attorney, Agent, or Firm* — Lawrence J. Shurupoff

(57) ABSTRACT

An alarm system includes a battery-powered base unit having an audible alarm, a switched constant on constant off light which can be used as a flashlight, and a strobed light providing a visible position indicator. The audible alarm and strobed light are activated simultaneously upon the release of a pull pin from a pair of electrical contacts within the base unit. The strobed light can be visible or infrared. A trip line can be connected to the pull pin to provide a secure line of entry or a secured enclosed area.

18 Claims, 3 Drawing Sheets

COMPACT MULTIFUNCTION PERIMETER AND PERSONAL SECURITY ALARM SYSTEM

CROSS-REFERENCE TO RELATED APPLICATIONS

This application claims the benefit and priority of U.S. Provisional Application No. 61/672,676, filed Jul. 17, 2012, entitled "Compact Multifunction Perimeter Security System" which is incorporated by reference herein in its entirety.

BACKGROUND AND SUMMARY

A small lightweight alarm can serve as a perimeter tripwire alarm, as a signaling device in both light and dark, as a flashlight and as a personal security alarm. One or more of the alarm units can be used to enclose and secure a small or large perimeter, such as a road, a path, a campground or a tactical position. An audible alarm can be activated manually on demand as a personal security alarm by operating a switch or unintentionally by an intruder by engaging a tripwire.

In one embodiment a loud chirping alarm is accompanied by a flashing or strobing light, while in another embodiment a loud chirping alarm is accompanied by strobing infrared light. In each embodiment, the alarm including both audible and visual alarm components is activated by removing a pull pin from the body of the alarm. The flashing or strobing light can be activated without an audible alarm with a separate user-actuated switch.

To set up the alarm as a perimeter tripwire alarm, a compact alarm base unit is secured in place in any convenient manner. The base unit can be provided with a kit which includes a strip of adhesive tape, such as black duct tape having a peel-off backing, several meters or more of monofilament trip line, one or more compact wafer-shaped light assemblies and one or more nylon zip ties or "tie wraps."

The base unit can be provided with an adhesive backing having a peel-off cover. The base unit can be adhesively mounted on almost any surface, such as a clean flat glass, plastic, wood or metal surface, with an adhesive provided on the back of the base unit, such as a double sided foamed adhesive tape. The adhesive can be exposed by peeling off its protective cover. The base unit can then be adhesively fixed in position by simple manual pressure of the adhesive backing against virtually any substrate.

Alternatively, adhesive tape, tie wraps, rope, bungee cords or other fasteners can be used to secure the base unit in place. Even trees, logs, cut branches, rocks and the like can be used as a substrate to secure the base unit in position on the perimeter of a secured area.

Once the base unit is secured in position, a monofilament trip line is tied to the pull pin. The pull pin is inserted in an alarm switch and stretched across a trail, path, road, open area or any other desired perimeter or location to be secured. The other free end or "bitter end" of the trip line is secured to a fixed object at the next position on the perimeter. A simple knot in the trip line can be used to fix the free end of the trip line to any suitable anchor point. Alternatively, a compact light assembly as described below can be used for this purpose if a somewhat flat surface is available. One or more separate compact light assemblies can be provided in a kit along with the base unit, trip line, tape and ties.

The compact light assembly or light assemblies provided in the kit have an adhesive backing with a peel-off cover allowing a compact light assembly to be adhesively mounted to virtually any surface which is preferably clean and dry.

Alternatively, the compact light assembly can be mounted on the base unit and illuminated with a simple manual push on a three way pressure switch. A first press illuminates a fast strobing light which in one embodiment is a blue LED light. A second press illuminates a slow strobing light, a third press illuminates a constant light and fourth press turns the constant light off and resets the compact light assembly to operate again in the same series of operating modes noted above.

The base unit can further include one or more lights operated by an on-off switch, such as a manual sliding switch. In one embodiment, a red LED light is provided on the base unit serving as a flashlight for reading maps in the dark, viewing other objects in the dark or signaling in the light or dark. One or more blue LED lights can also be provided on the base unit for signaling or for identifying blood stains, such as when tracking a wounded animal The blue lights can be activated by a strobing circuit to provide a strobe light effect. The manual sliding on-off switch can select a strobing mode on the blue lights. Removing the pull pin will also activate the strobing mode on the blue lights, as well as the audible alarm to provide an effective personal security alarm or alternatively, a trip wire perimeter alarm providing both audible and visual alarm signals.

In one embodiment, the blue light is strobed and directed into a clear plastic light pipe for light transmission and concentration. The light pipe can include grooved or prism-shaped internal surfaces which efficiently direct light away from the base unit in a predetermined direction or directions.

In another embodiment, the blue light is replaced with an infrared light, such as an infrared light emitting diode (LED), which can be provided with a strobing function. This infrared light can be used in conjunction with night vision infrared viewing apparatus, such as used in military and tactical operations. The infrared light allows for the detection of the position of the base unit at night without alerting others without the aid of night vision viewing equipment.

DETAILED DESCRIPTION OF REPRESENTATIVE EMBODIMENTS

Figure 1:
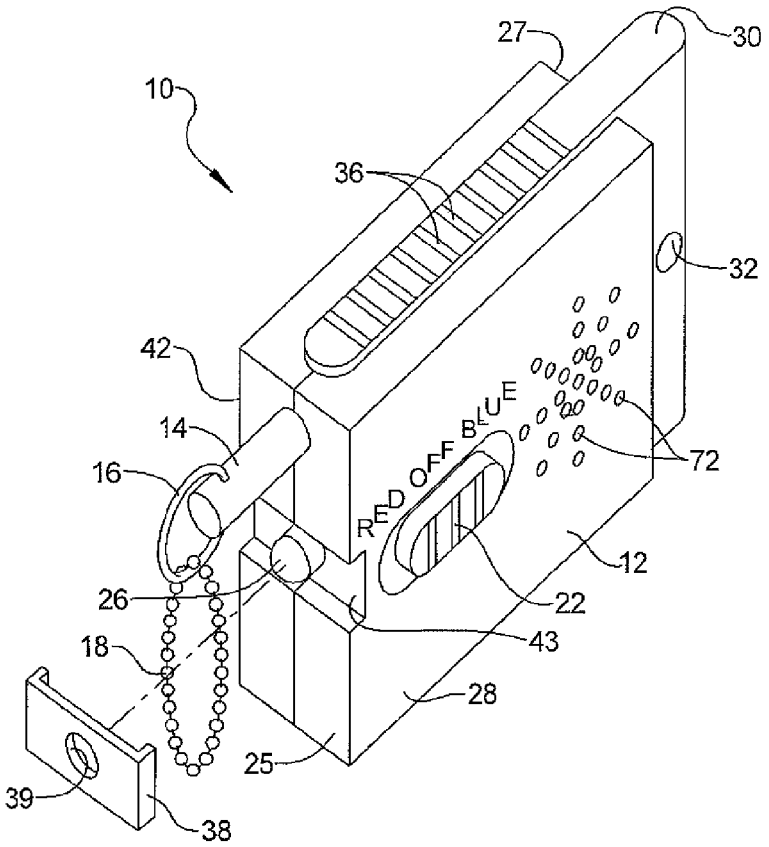
FIG. 1 is a partially exploded top perspective view of a representative embodiment of a base unit of a multifunction perimeter security system constructed in accordance with this disclosure.
Figure 2:
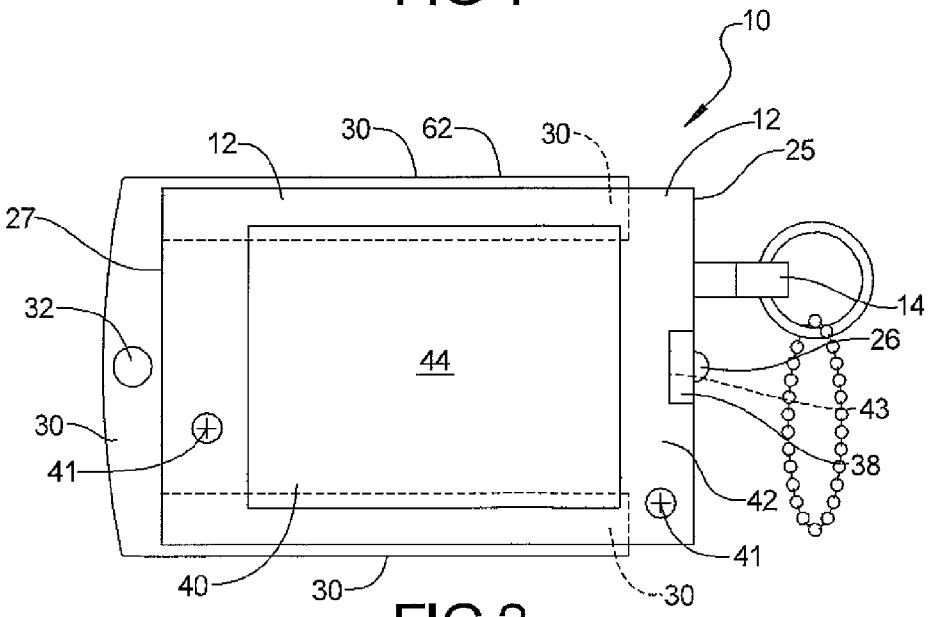
FIG. 2 is a rear elevation view of the base unit of FIG. 1.

As seen in FIGS. 1 and 2, a base unit 10 of one embodiment of a compact multifunction perimeter security system includes a three-piece plastic housing 12 holding one or more batteries, one or more light emitting diodes (LEDs), switching circuitry, an audio alarm, a sliding light mode selection switch and an alarm switch as described more fully below. The audio alarm can be activated by a pull pin 14 which can include a pull ring 16 and a key chain 18.

The embodiment shown in FIGS. 1 and 2 is approximately drawn to actual size with a total length of about 2.5 inches, a width of about 0.75 inches and a height of about 1.25 inches. The weight of the base unit as shown in FIG. 1 is about 1.2 ounces including a battery.

A sliding 3-position ribbed switch actuator 22 operates a red LED 26 mounted in one side wall 25 of the housing 12. LED 26 is designed to be operated in a constant on or off mode and serve as a flashlight positioned adjacent the pull pin 14. Sliding the switch actuator 22 from a central "off" position toward the sidewall 25 turns on the red LED with a constant illumination, and sliding the switch actuator 22 back to its central position turns the red LED off.

Sliding the switch actuator 22 from the central off position away from the sidewall 25 and red LED 26 and towards the opposite side wall 27 turns on two blue LEDs 60 (FIG. 3) mounted inside the housing 12. Each blue LED 60 is operated to flash on and off by a strobing circuit provided in the housing 12. Each blue LED 60 is disposed in the housing 12 adjacent each leg portion 62 of a light pipe 30 which can take the form of a U-shaped clear plastic yoke extending along and above opposite top and bottom sides of the housing 12 for increased visibility. One or more infrared LEDs can replace the blue LEDs 60 for use in tactical operations. The housing 12 includes a front pan-shaped wall 28, a rear pan-shaped wall 42 and a U-shaped clip 38 having an opening 39 formed therethrough for receiving the LED 26. The front and rear walls are clamped together around and against the light pipe 30, such as by fasteners or screws 41 (FIG. 2). The clip 38 is snap fit into recesses 43 formed in the sidewall 25 of each of the front and rear walls 28, 42.

Figure 3:
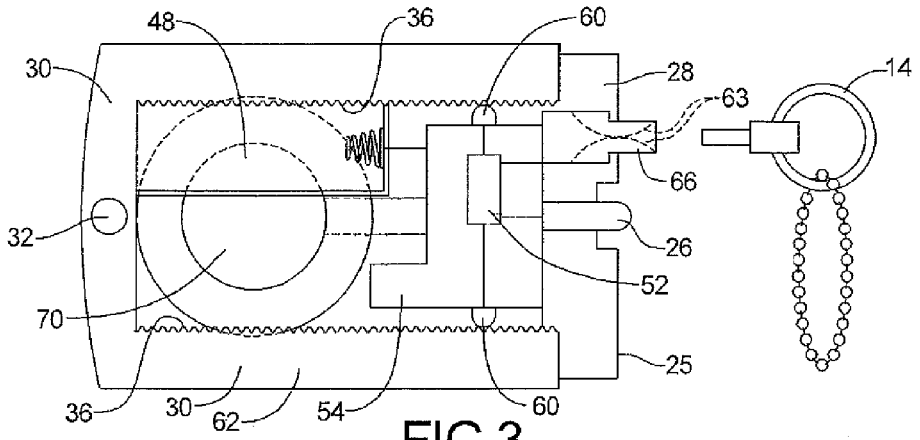
FIG. 3 is a view of FIG. 2 with the rear cover removed and the pull pin released.

The light pipe 30 may extend outwardly from one side 27 of the housing 12 to maximize the surface area over which the blue light or any other color of light is emitted. A mounting bore 32 is formed though the projecting front edge of the light pipe 30 to allow the base unit 12 to be secured in place via bore 32 with a tie wrap, rope, etc. or to be worn on a bracelet or lanyard as a personal safely alarm. As seen in FIG. 3, the light pipe 30 can be formed with internally contoured or prism surfaces 36 to concentrate and radiate LED light in a predetermined direction or directions from the top and bottom surfaces of the housing 12. Light is also projected from the portion of the light pipe extending outwardly from the sidewall 27 of the housing 12 for maximum visibility.

The base unit 10 may also be secured in place with tape, such as black electrical tape or black duct tape. Black tape is useful in hiding the base unit and preventing its detection. A strip of adhesive 40 (FIG. 2), such as a double-sided foam adhesive strip with adhesive on both sides can be adhesively mounted on the back wall 42 of the housing 12. A peel-off cover strip 44 can cover the adhesive strip 40 in the manner of an adhesive bandage cover. When the peel-off cover strip 44 is removed, the base unit 10 can be adhesively mounted to most surfaces, preferably flat, clean surfaces.

As further seen in FIG. 3, the light pipe 30 can be molded in one piece with a recessed rectangular battery compartment 48. A conical spring 50 holds a battery within the battery compartment 48 and forms part of an electrical circuit which drives the lights and alarm. A battery (not shown) held in compartment 48 powers a switching circuit 52 provided on circuit board 54 mounted to the inner surface of the front wall 28. The switch 22 (FIG. 1) selectively directs battery power via switching circuit 52 to one or more and advantageously to a pair of LEDs 60 positioned adjacent each leg portion 62 (FIG. 3) of the light pipe 30. Switching circuit 52 preferably provides a rapidly strobing or pulsing activation and illumination of the LEDs 60. LEDs 60 are preferably blue LEDs, but any other color LEDs can be used as well as infrared LEDs.

Switch 22 also selectively delivers battery power to LED 26 via switching circuit 52. LED 26 is preferably driven with a constant power for constant illumination. LED 26 is preferably a red LED, but any other color LED can be. In this manner, LED 26 can be used as a miniature flashlight.

When the pull pin 14 is removed from switch housing 66 as shown in FIG. 3, a pair of electrical spring contacts 63 biased toward each other close together completing a circuit which delivers driving power to a circular speaker 70 carried inside housing 12. A very loud (135 dB) audible alarm is driven through a spoked pattern of openings 72 (FIG. 1) in the front wall 28 by the speaker 70. At the same time, circuit 52 is activated to deliver strobed power to the pair of LEDs 60.

While the audible alarm will provide an alert that the pull pin has been activated, such as by a user requiring a safety or locating alarm or by a trip line as discussed below, a visual signal is also simultaneously provided by the strobed LEDs 60. This is particularly helpful at night when more than one base unit 10 may be deployed over a lengthy perimeter. The strobed light will assist in locating exactly which base unit 10 has been activated or tripped, and the corresponding location of a potential intruder. If infrared LEDs 60 are used, an intruder will not realize their position is visible to those using infrared viewing devices.

Figure 4:
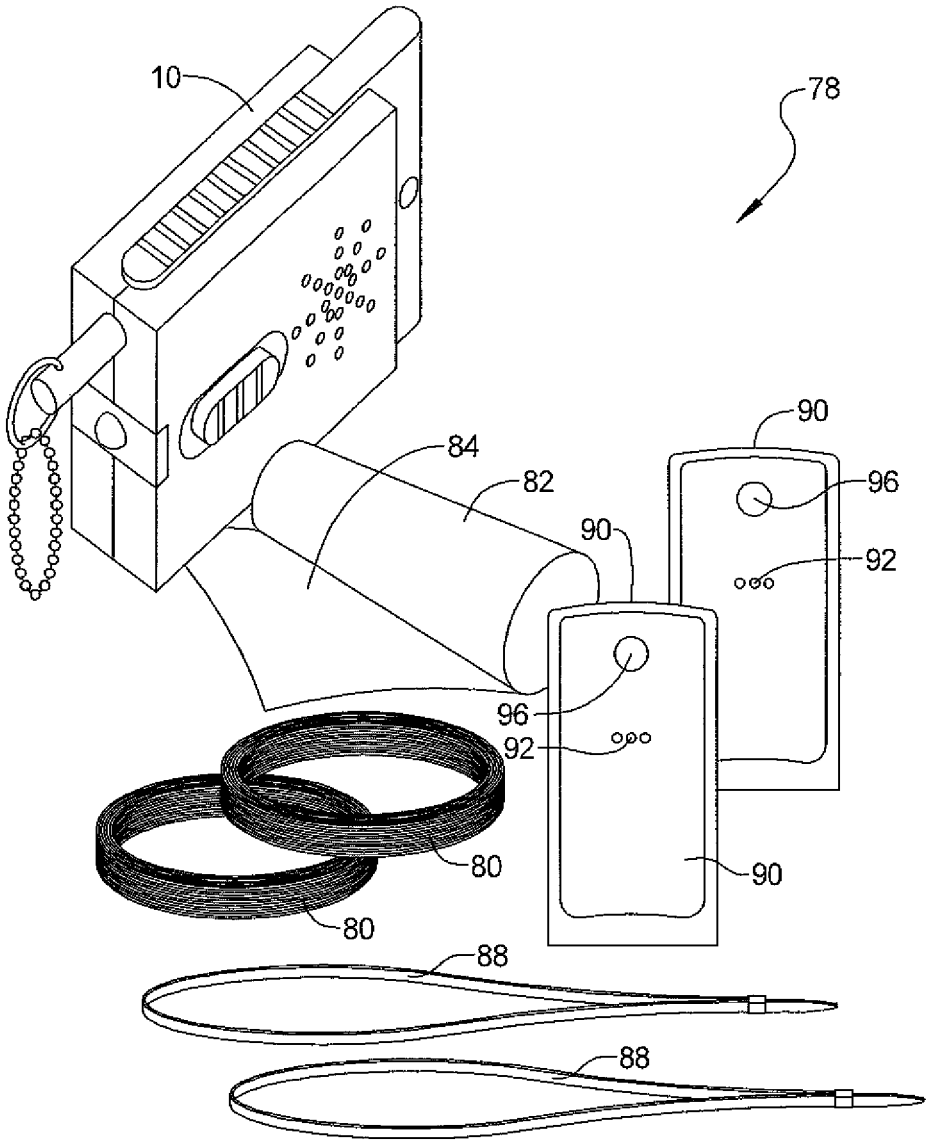
FIG. 4 is a perspective view of a number of components provided in a kit forming one example of a multifunction perimeter security system.

As seen in FIG. 4, the base unit 10 may be provided in a prepackaged kit 78 along with one or more lengths of trip line, such as coils of monofilament line 80 such as in the form of 10 pound fishing line. A strip of black duct tape 82 with a peel off cover 84 can also be provided in the kit 78 along with one or more plastic tie wraps or zip ties 88.

The kit 78 can further include one or more compact wafer-thin (about ⅛-3⁄16 inch thick) compact signal light assemblies 90. Light assemblies 90 can be provided in the form of a wafer light about two inches long and about one inch wide and include a battery powered switching circuit encapsulated in a clear plastic waterproof sheath. One or more LEDs 92 are centered in a thin silver light reflective foil within the waterproof sheath when a visible LED is used. If an infrared LED is used, the LED 92 is centered in a thin black plastic strip. The reflective foil can be used to reflect the light from the LED at night and can also be used to reflect sunlight in the day to signal one's location, even with a dead battery. A representative example of a suitable wafer light assembly for use with kit 78 is described more fully in U.S. Publication No. US-2012-0318985-A1, published Dec. 20, 2012 under Ser. No. 13/395,612 and which is incorporated herein by reference in its entirety.

As further seen in FIG. 4, each light assembly 90 includes an adhesive backing with a peel-off cover to enable the light assembly 90 to be adhesively fixed to most surfaces, particularly to clean, flat surfaces. One or more light assemblies 90 can be used to fix the free end of a trip line 80 to virtually any surface. A pressure-operated button switch 96 can be finger pressed to operate a switching circuit provided on a thin circuit board within the light assembly 90. A first press and release of switch 96 causes the LEDs 92 to strobe rapidly, a second press of switch 96 causes the LEDs 92 to strobe slowly, a third press of the switch 96 causes the LEDs 92 to shine with a constant light and a fourth press of switch 96 turns off the LEDs 92 and returns the switching circuit to its prior switching cycle.

Figure 5:
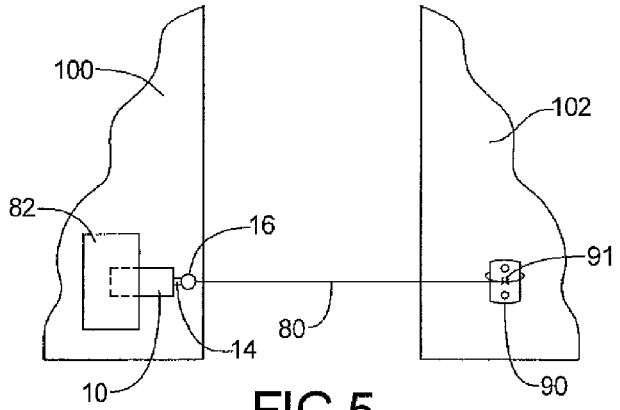
FIG. 5 is a partial schematic view of one application of the kit of FIG. 4.

An example of one application of the alarm kit is shown in FIG. 5 wherein the base unit 10 is secured to a first surface such as a first building 100 with duct tape 82. A trip line 80 is tied to the pull pin 14 via the pull ring 16 and extends across an alley, trail, path or other area to another surface such as a second building 102. The free end or bitter end of the trip line 80 is shown adhesively held on and secured to the second building 102 with the adhesive backing on a compact wafer light assembly 90. A knot 91 can be tied around the compact wafer light assembly 90 for additional support.

An intruder passing between the buildings 100, 102 will engage the trip line 80 causing the trip line to pull the pin 14 from the switch housing 66 causing an alarm to sound. If a visible LED 60 is provided in the base unit 10, a visible strobing light will also simultaneously illuminate. If an infrared LED 60 is provided in the base unit 10, only those using night vision equipment, such as infrared detecting goggles, will be able to see a strobing infrared light.

Figure 6:
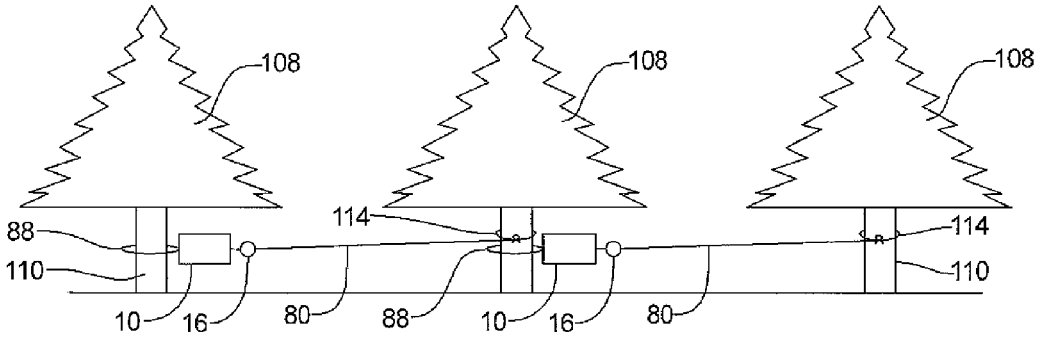
FIG. 6 is a schematic view of a second application of two or more of the kits of FIG. 4.

Another example of an application of the alarm kit is shown in FIG. 6 wherein a series of base units 10 is attached to a series of trees or bushes 108 to provide an extended protected perimeter. The base units 10 can be arranged in any desired open or closed perimeter configuration. For example, a circular, rectangular or irregular area can be enclosed or surrounded with a series of base units 10 and trip lines 80.

In the example of FIG. 6, the base units 10 are anchored with zip ties 88 surrounding a tree trunk or branch 110 and passing through each mounting bore 32 (FIG. 2). The bitter end of each trip line 80 is secured to a tree trunk or branch 110 along the perimeter with a simple knot 114.

It will be appreciated by those skilled in the art that the above compact multifunction perimeter security system is merely representative of the many possible embodiments of this disclosure and that the scope of this disclosure should not be limited thereto, but instead should only be limited according to the following claims.

What is claimed:

1. An alarm system, comprising:
- a housing;
- a battery provided in said housing;
- an audible alarm provided in said housing and powered by said battery;
- a first light provided in said housing and powered by said battery;
- a pull pin coupled to said housing;
- a first switch activated by said pull pin;
- a switching circuit provided in said housing and electrically connected to said first switch;
- a second manually-actuated switch coupled to said housing and selectively connecting said first light to said switching circuit to manually turn said first light on and off;
- wherein said audible alarm and said first light are activated upon release of said pull pin from said first switch; and
- a light pipe provided in said housing and transmitting light from said first light to ambient, said light pipe comprising a contoured prism surface.

2. The alarm system of claim 1, wherein said switching circuit comprises a strobe circuit causing said first light to strobe on and off.

3. The alarm system of claim 1, further comprising a second light provided in said housing and controlled by said second manually-actuated switch to provide a constant on operating mode and a constant off mode.

4. The alarm system of claim 3, wherein said second light comprises an LED emitting visible red light.

5. The alarm system of claim 1, wherein said first light comprises a first LED emitting visible light.

6. The alarm system of claim 1, wherein said first light comprises a first LED emitting infrared light.

7. The alarm system of claim 1, further comprising an adhesive provided on said housing for mounting said housing to a substrate.

8. An alarm kit, comprising;
- a housing;
- a battery provided in said housing;
- an audible alarm provided in said housing and powered by said battery;
- a first light provided in said housing and powered by said battery;
- a pull pin coupled to said housing;
- a first switch activated by said pull pin;
- a switching circuit provided in said housing and electrically connected to said first switch;
- a second manually-actuated switch coupled to said housing and selectively connecting said first light to said switching circuit to manually turn said first light on and off;
- wherein said audible alarm and said first light are activated upon release of said pull pin from said first switch;
- a length of trip line having one end for coupling to said pull pin and a second end;
- a zip tie for attaching said base unit to a first support;
- an adhesive tape for attaching said base unit to the first support; and
- a wafer light having an adhesive backing for coupling said second end of said length of trip line to a second support.

9. The alarm kit of claim 8, wherein said wafer light comprises an LED and a switching circuit providing selective manual switching of said LED from a strobing light to a constant light.

10. The alarm system of claim 8, wherein said base unit comprises a mounting bore for receiving said zip tie and mounting said base unit to the first support.

11. A compact multifunction alarm unit, comprising:
- a housing having a front wall, a rear wall, a first side wall and a second side wall;
- a light pipe carried by said housing;
- a first LED disposed adjacent said light pipe for projecting light therethrough;
- a second LED provided in said first side wall;
- an audible alarm carried by said housing;
- a battery electrically connected to said first and second LEDs and to said audible alarm; and
- a pull pin releasably engaged with said housing such that removal of said pull pin simultaneously activates said audible alarm and said first LED.

12. The alarm unit of claim 11, further comprising a switching circuit disposed in said housing and providing a strobing activation of said first LED.

13. The alarm unit of claim 11, further comparing an on-off switch on said housing for selectively operating said second LED.

14. The alarm unit of claim 11, wherein said light pipe extends partially outside of said housing and distributes light from said first LED to ambient.

15. The alarm unit of claim 11, further comprising a third LED disposed adjacent said light pipe.

16. The alarm unit of claim 15, wherein said housing further comprises top and bottom sides and wherein said light pipe extends along said top and bottom sides and wherein said second and third LEDs are respectively arranged adjacent said top and bottom sides.

17. The alarm of claim 11, further comprising a manual switch carried on said housing and selectively operating said first and second LEDs.

18. The alarm unit of claim 11, wherein said first LED comprises an infrared LED.

* * * * *